US006920933B2

(12) United States Patent
Watson et al.

(10) Patent No.: US 6,920,933 B2
(45) Date of Patent: Jul. 26, 2005

(54) PLATFORM FOR DELIVERY OF DOWNHOLE TOOLS

(75) Inventors: Roger C. Watson, Frisco, TX (US); Flint R. George, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 16 days.

(21) Appl. No.: 10/377,247

(22) Filed: Feb. 27, 2003

(65) Prior Publication Data

US 2004/0168812 A1 Sep. 2, 2004

(51) Int. Cl.[7] ..... E21B 12/00
(52) U.S. Cl. ..... 166/381; 166/155; 166/156
(58) Field of Search ..... 166/381, 243, 166/153, 155, 156

(56) References Cited

U.S. PATENT DOCUMENTS 2,262,117 A * 11/1941 Roe ..... 166/123
2,908,333 A * 10/1959 Schwab ..... 166/214
3,199,596 A * 8/1965 Wood ..... 166/115
3,990,507 A 11/1976 Vann
4,078,611 A 3/1978 Vann
4,452,306 A * 6/1984 Polley ..... 166/155

* cited by examiner

*Primary Examiner*—William Neuder
(74) *Attorney, Agent, or Firm*—David W. Carstens

(57) ABSTRACT

A platform is used to deliver a tool down a hole by controlling the flow of fluid through and around the platform. The platform has a top surface for receiving the tool. The platform also has a bottom surface to provide guidance through and resistance to the flow of fluid. The lower surface of the platform can be engineered to steer the platform against an inner wall of the casing. This slows the descent by adding mechanical friction to its descent. The lower surface can also be engineered to add a predetermined amount of resistance to the flow of the well fluid across it. A stop on the casing already in place in the well stops the descent of the tool at a desired depth. Once the tool is no longer needed, a fishing tool can be lowered from the same crane to retrieve the tool and platform. Use of a crane substantially decreases the cost of the operation compared to the need for a rig.

23 Claims, 7 Drawing Sheets

PLATFORM FOR DELIVERY OF DOWNHOLE TOOLS

BACKGROUND OF THE INVENTION

1. Technical Field

The present invention relates to a platform that can be used to deliver a tool to a downhole location in a well substantially filled with a fluid. The platform is also referred to as a "float shoe." It provides a controlled descent into the drill hole by metering drilling fluid in the hole through a plurality of ports. The platform is not coupled to the surface by wire or tubing.

2. Description of the Related Art

Various tools are needed during the completion of a well. Once the casing has been cemented into place, for example, a perforation gun is then lowered into the well to the desired depth and discharged. The explosive charges perforate the casing, cement, and adjacent formation. The perforation gun is lowered into the well at the end of a wire, or at the end of rigid or flexible tubing. In either scenario, a rig must be used to lower the tool into the well. The cost of this additional equipment obviously raises the overall cost of completing the well.

FIG. 1 illustrates an example of the prior art method 100 of lowering a tool into a well. A borehole 12 is made into the ground 10. The hole penetrates a formation of interest 18. To stabilize the walls of the hole 12, a casing 14 is lowered into the hole and cement is pumped into the annular space between the casing and hole. It is common for fluids to fill the cased well. These fluids include drilling fluids that are used in the drilling process. The fluids can also include hydrocarbons that leak from the formation 18. The fluid 16 might also contain salt water, as this is commonly encountered when drilling wells. This mixture of fluids has a unique viscosity based upon the constituent elements of the fluid. The tool 40 is shown being lowered into the well by tubing that is in turn being lowered by a derrick 102. The derrick 102 has a crown block 108 and pulley system 106. A cable 104 is used to manipulate, lift, and lower the tubing into the well. This is just one illustration of a generic configuration used for delivering a tool to a downhole location.

There are many types of tools that can be lowered into a well. For example, the tool could be a perforation gun used to perforate the casing adjacent to the formation 18. Another tool might be a packer used to isolate one part of the well from another. Different tools are used during the drilling of a well, its completion and during the production phase of the well. In each situation, the cost of using the tool adds to the overall cost of the well. Much of this cost is attributable to the cost of construction a derrick to support the tubing used to convey the tools. A need exists for a simpler, less expensive method of delivering a tool safely to a downhole location.

SUMMARY OF THE INVENTION

The present invention relates to a delivery platform that safely and inexpensively delivers a tool to a downhole location. The platform is specially engineered to receive a tool on its upper surface. It can then be lowered into a well by a crane and released. The tool and platform then glide through the fluid filling the well. Flow passages are provided in the platform meters the flow of fluid. This controls the velocity of the downward descent. No cable or tubing is connected to the platform during its descent. A stop on the casing already in place in the well stops the descent of the tool at a desired depth.

Once the tool is no longer needed, a fishing tool can be lowered from the same crane to retrieve the tool and platform. Use of a crane substantially decreases the cost of the operation compared to the need for a rig.

The ability to control the descent of the tool is crucial to the success of this invention. The lower surface of the platform can be engineered to steer the platform against an inner wall of the casing. This slows the descent by adding mechanical friction to its descent. The lower surface can also be engineered to add a predetermined amount of resistance to the flow of the well fluid across it. Finally, the flow passages can be used to further decrease the resistance to flow experienced by the fluid in the well. The passages can be internal or on the outer surface of the platform. The passages can be substantially aligned with the axis of the platform or take a more tortuous path such as spiraled, to increase the resistance to flow further. The flow passages can be equipped with caps to allow a user to alter the level of resistance to flow in response to the viscosity of the fluid.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

Figure 1:
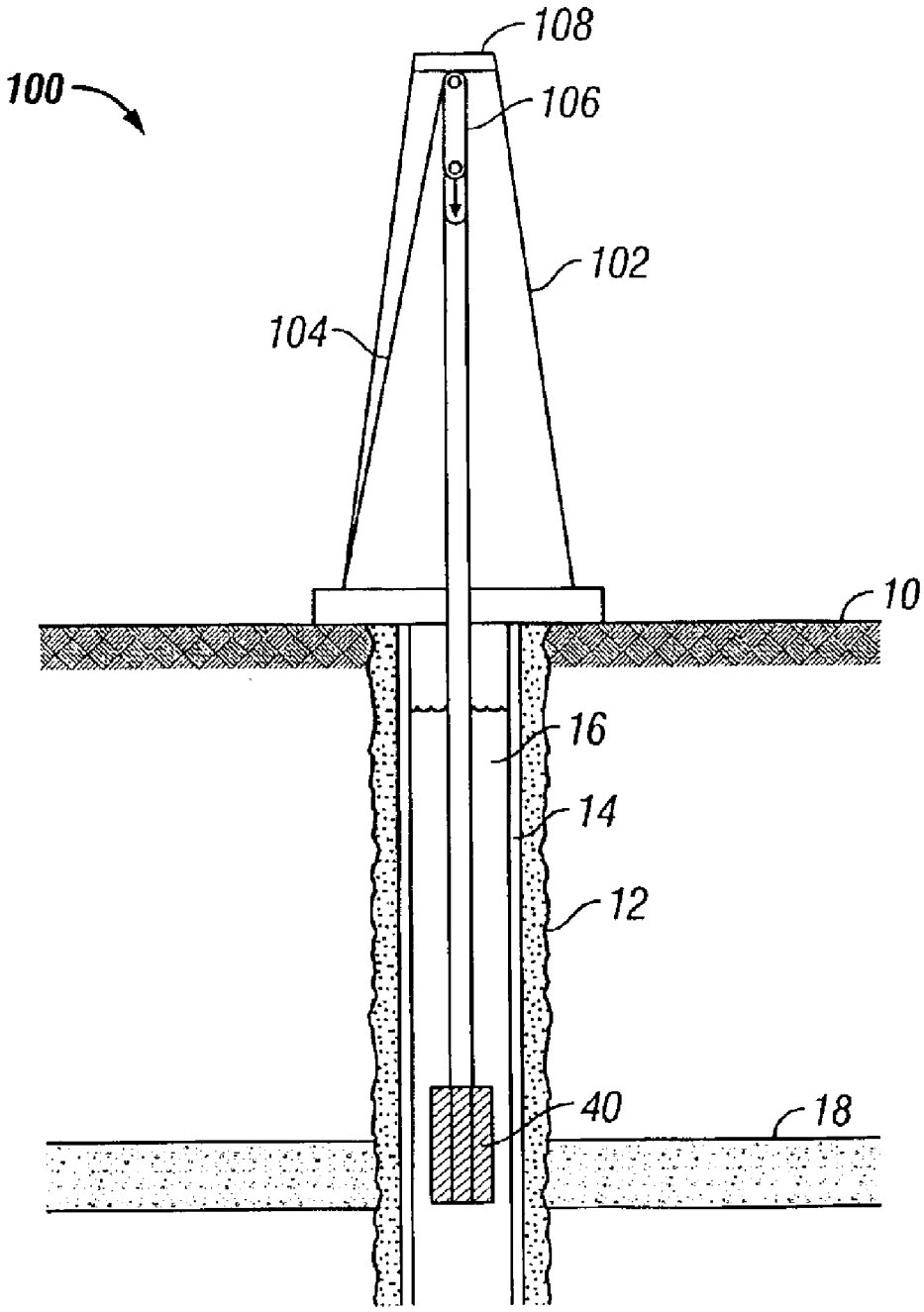
FIG. 1 (Prior Art)
FIG. 1 illustrates a prior art method of lowering a tool into a well.
Figure 2B:
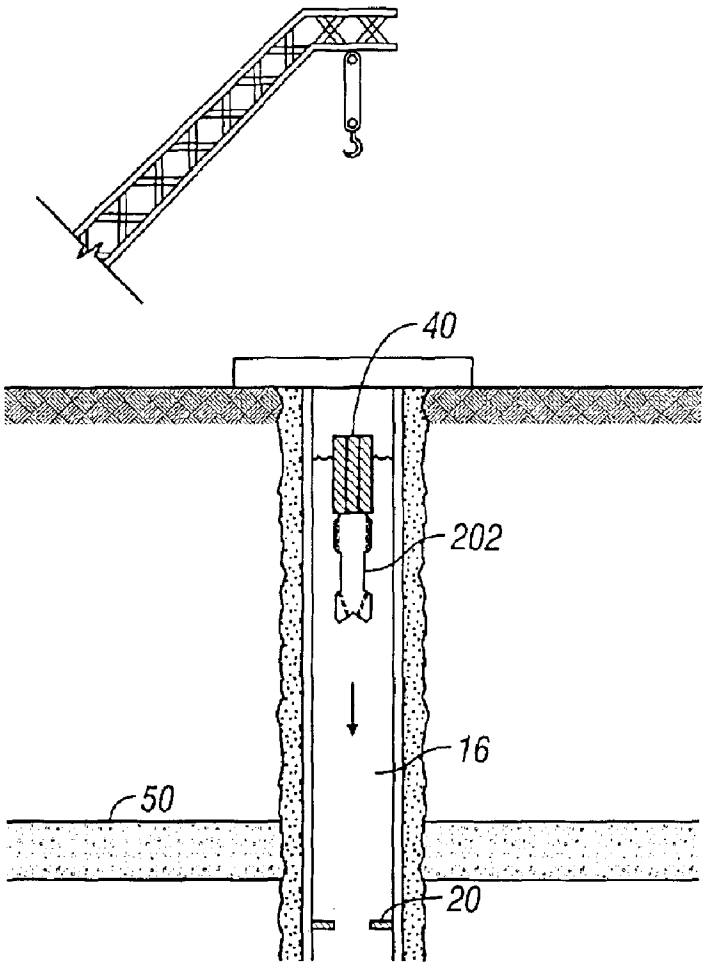
FIGS. 2A, 2B and 2C show a method of lowering a tool into a well that embodies the present invention.
Figure 2A:
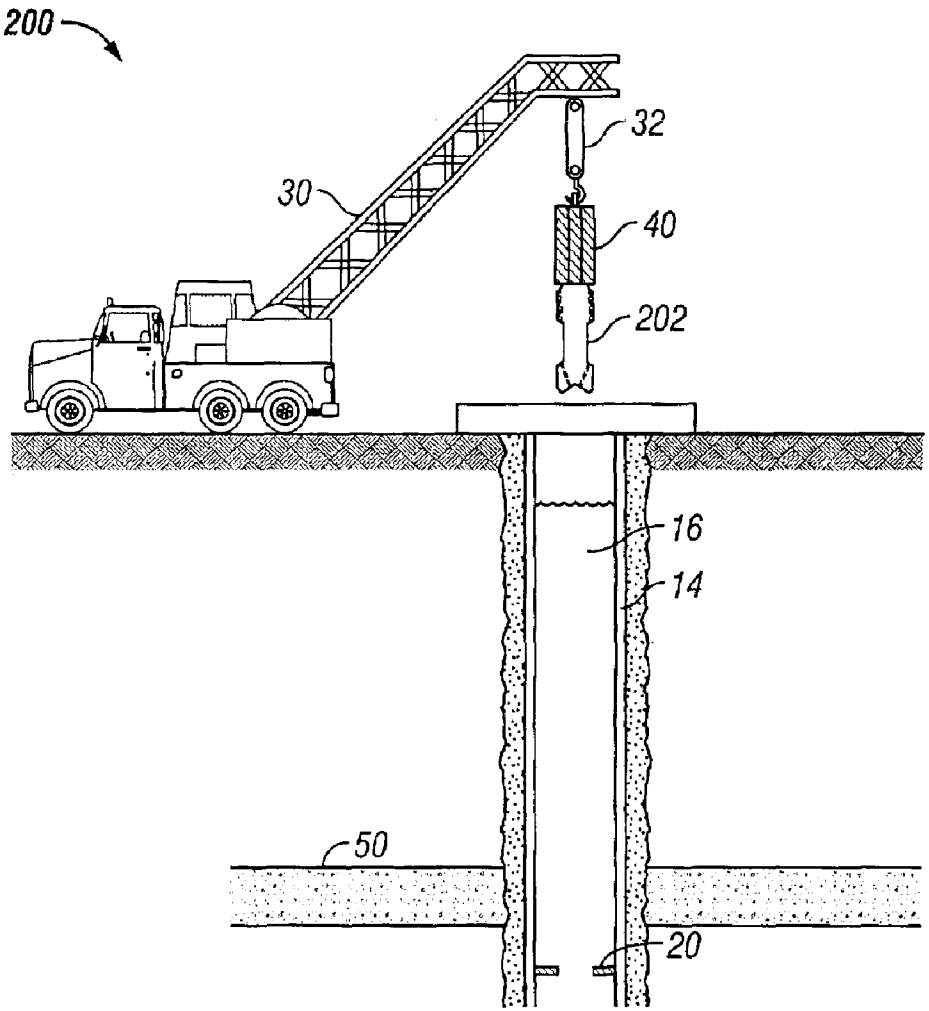
Figure 2C:
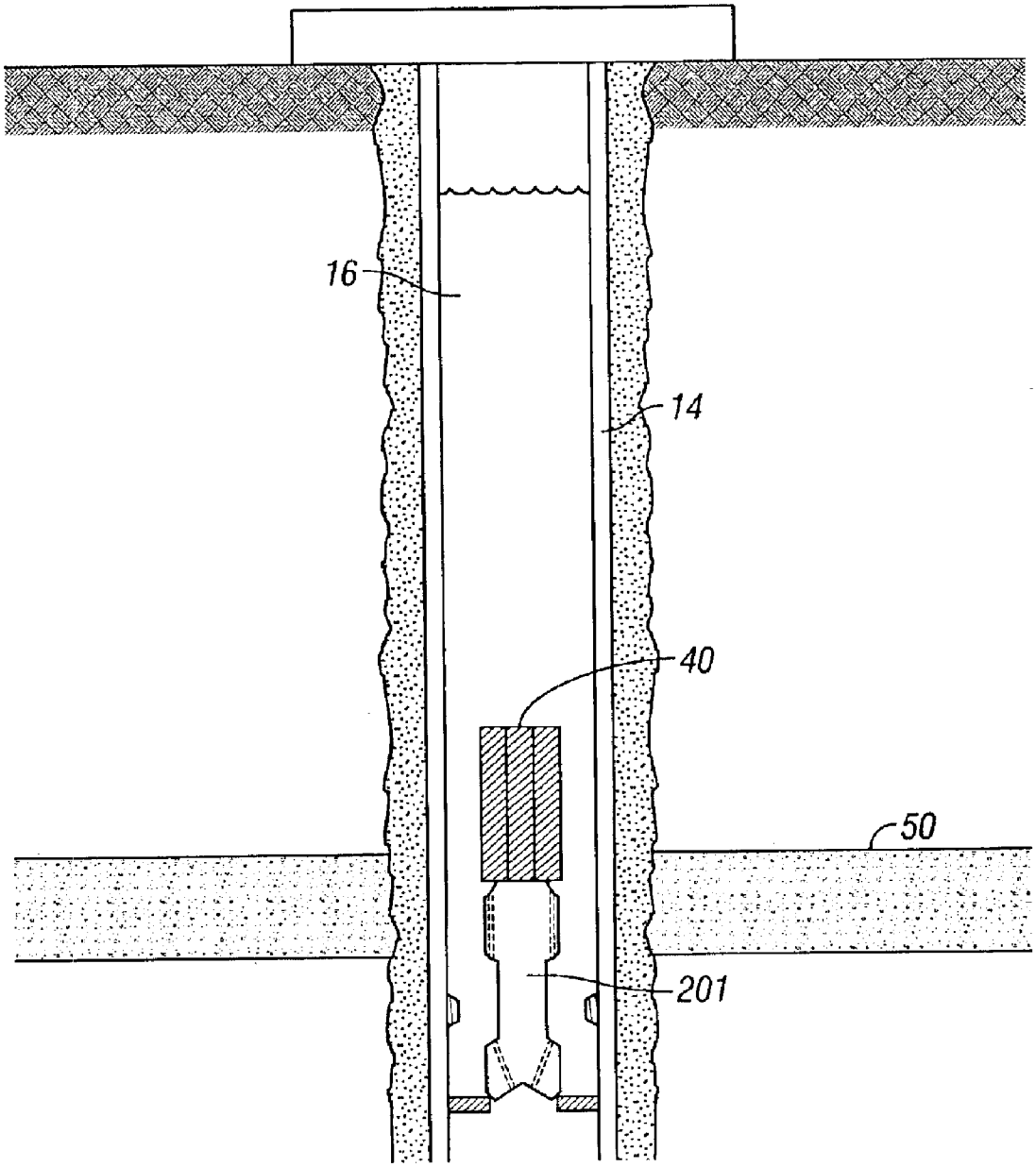

The improved method of delivering a tool to a downhole location is shown in FIGS. 2A, 2B, and 2C. The platform 202 is specially engineered to receive a tool 40 on its upper surface. It can then be lowered into a well by a crane 30 and released. The tool and platform then glide through the fluid 16 substantially filling the well 14. Flow passages are provided in the platform meters the flow of fluid. This controls the velocity of the downward descent. No cable or tubing is connected to the platform during its descent. The platform is only attached to the crane 30 during its positioning. A stop 20 on the casing already in place in the well stops the descent of the tool at a desired depth 50. Once the tool is no longer needed, a fishing tool can be lowered from the same crane to retrieve the tool and platform.

While the well is shown as substantially vertical in the figures, an average well may well deviate from vertical. Deviations can be intentional and unintentional. Thus, when the platform is released into the well, there is a likelihood that it will impact the casing. In some instances the platform might even become jammed in a location above the desired depth. In this case, it is beneficial to have the platform made of a material that is softer than the casing so that the platform is damaged rather than the casing. This is especially important when the platform must be wrested from the well. The platform can be destroyed during that operation while causing minimal damage to the casing. For example, the platform might be made of aluminum or a composite while the casing may be made of hardened steel. Further, for ease of manufacture, the material should be drillable.

Figure 3A:
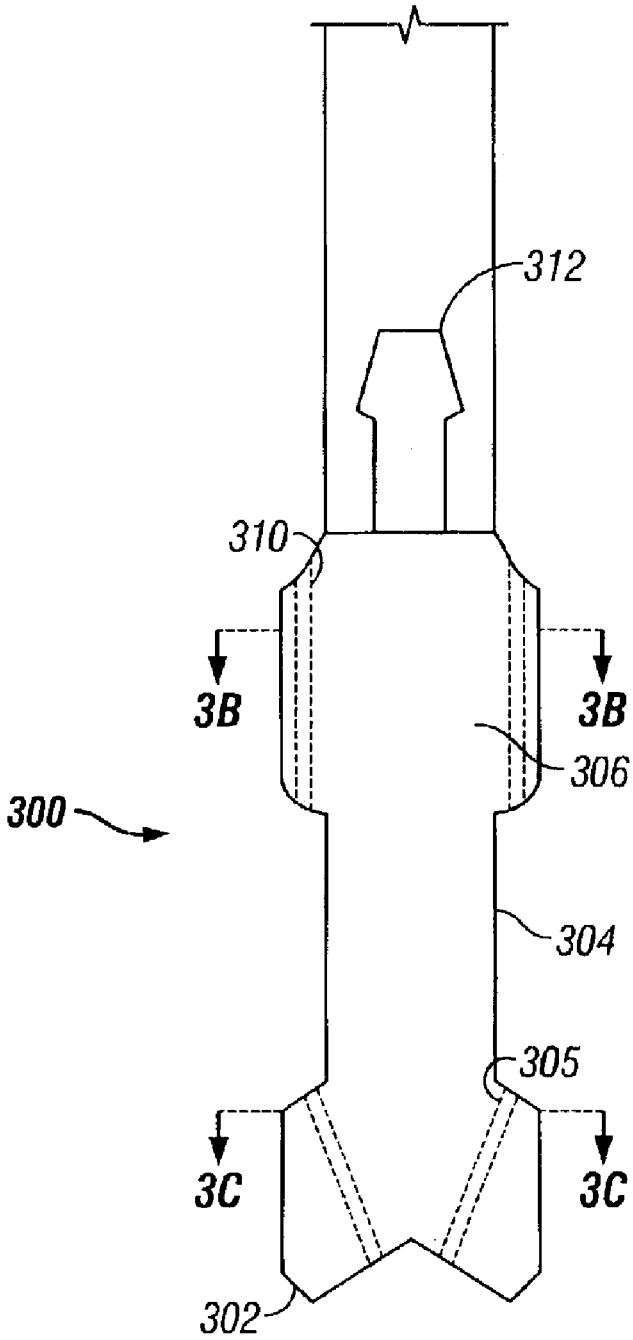
FIGS. 3A, 3B, and 3C illustrate a delivery platform that embodies the present invention.

The means to control the descent of the tool is best illustrated by reference to FIGS. 3A, 3B, and 3C. Descent is primarily controlled by metering the fluid through various flow passages in the platform or on its surface. For example, passages 305 are located near the bottom surface and the middle portion of the platform. These passages are also shown in sectional view of FIG. 3C. Note that the passages are evenly distributed around the circumference of the platform. This provides uniform metering of fluid and does not bias the direction of the platform as it descends. The size of the holes can be increased or decreased to alter resistance to flow experienced by the fluid. For example, larger diameter passages allow a faster descent. Likewise, more passages allow a faster descent. And while several passages are shown in FIG. 3A, note that only a single passage is required if flow passages are used to meter the flow of fluid.

Figure 3B:
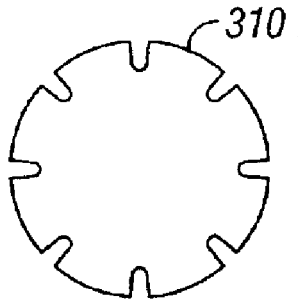
Figure 3C:
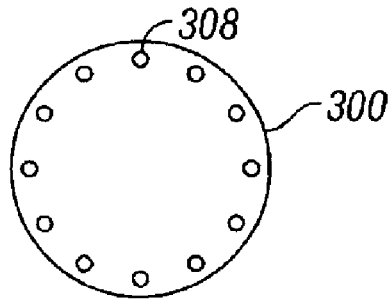

FIG. 3B shows another location for the passages. In this instance, the passages are on the surface 314 of the platform. Likewise, rather than angled passages, passages 310 are vertical or axial. Angled passages 308 provide a greater resistance to flow. The reduced diameter in middle of the platform also provides a means for controlling the fluid bypass past the tool. The reduction in diameter can be varied to increase or reduce the drag experienced by the platform. Another method of controlling the descent is the use of a fin or other steering surface. Another method of controlling the descent is to use a roughened surface on all or part of the platform. In one embodiment, the passages can be equipped with plugs to selectively close the passage. In another embodiment, the platform can be equipped with a coupler 312 for attaching the tool to the platform. If the platform and tool become lodged in the well, a fishing tool can be used to pull the tool. The coupler can be equipped with shear pins or other detachment means to facilitate the detachment of the tool from the platform.

Figure 4A:
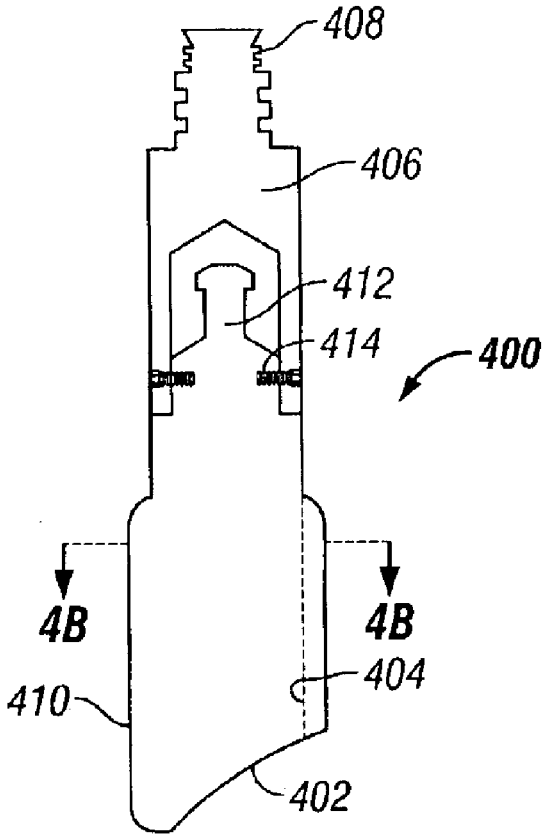
FIGS. 4A and 4B illustrate another embodiment of the present invention that incorporates a breakaway connector.
Figure 4B:
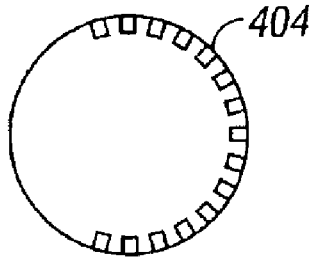

FIG. 4A shows another embodiment of the invention wherein the bottom surface 402 is angled or asymmetrically curved to steer the platform against one wall of the well. Passages 404 are also provided on only a portion of the circumference as shown in FIG. 4B. The friction between the platform and the casing also controls the speed of the descent. Again, a coupler 406 is shown coupled to the platform by shear pins 414.

It is important to understand that many elements of the design act as a means for metering the flow of fluid across the platform. Thus, the means for metering fluid flow should be interpreted broadly to include internal passages, external passages, a surface roughness, a steering fin, the bottom surface, and so forth.

Figure 5A:
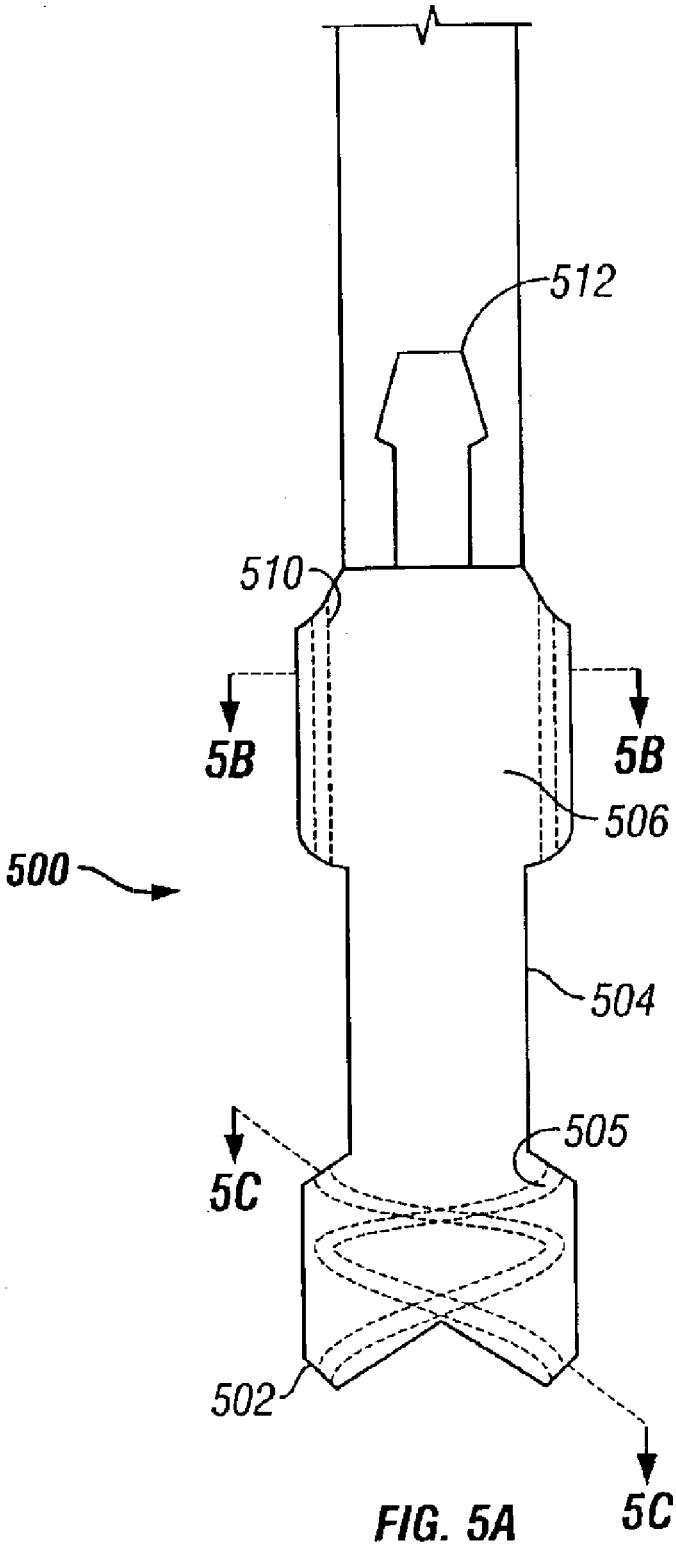
FIGS. 5A, 5B, and 5C illustrate a delivery platform that utilizes a spiral passage for fluid metering.
Figure 5B:
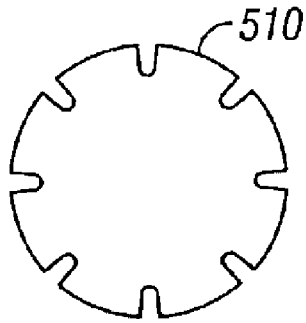
Figure 5C:
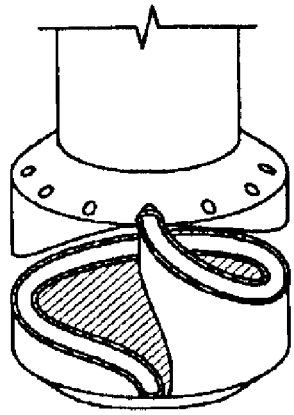

Referring to FIGS. 5A, 5B, and 5C, an alternate embodiment 500 of the present invention is shown. In this embodiment, the spiral passage 502 provides additional controlled metering of fluid through the delivery platform 500 until the fluid exits through port 505. This spiraled passage can also provide a counter rotation of the platform during its descent. The platform 500 can have a reduced diameter middle portion 504. However, in other embodiments, a reduced diameter portion could be located on the top or bottom ends of the platform. The top portion 506 is provided with external grooves 510. The exact shape, number, diameter, surface area, and smoothness of passages 502 or grooves 510 can be altered to increase or decrease the rate of the platform's descent.

Figure 6:
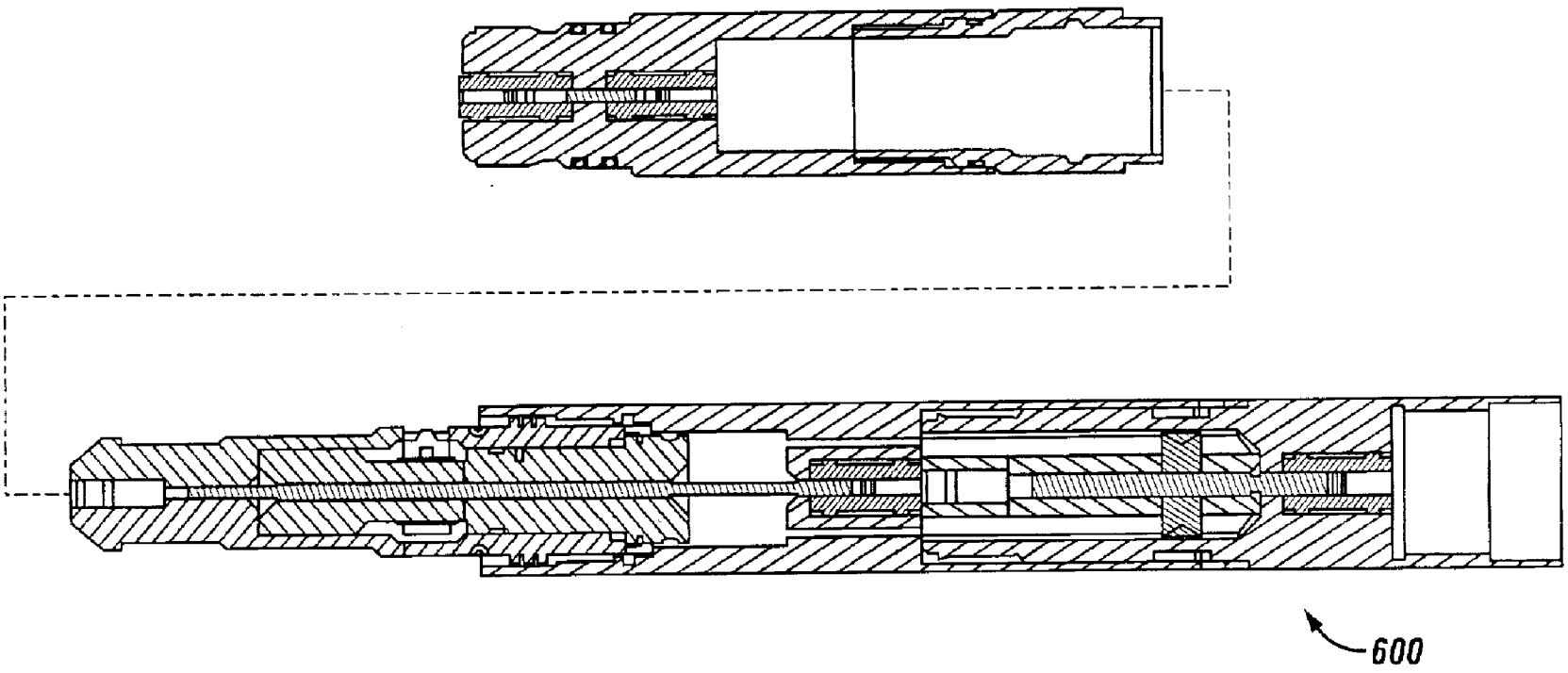
FIG. 6 illustrates a breakaway connector that also provides a primer pathway for conveying a detonation charge to an attached perforation gun.

FIG. 6 illustrates a specialized coupler for use when the tool is a perforation gun. When several modular perforation guns are positioned using the platform, the coupler 600 can be used to couple one gun to another. The coupler provides a primer to pass a detonation charge from one gun to the next.

Although preferred embodiments of the present invention have been described in the foregoing Detailed Description, and illustrated in the accompanying drawings, it will be understood that the invention is not limited to the embodiments disclosed but is capable of numerous rearrangements, modifications, and substitutions of steps without departing from the spirit of the invention. For example, other tools that could be positioned using this platform include a time delay firing head, a pressure actuated firing head, a drop bar firing head, and separating gun modules. Accordingly, the present invention is intended to encompass such rearrangements, modifications, and substitutions of steps as fall within the scope of the appended claims

We claim:

1. A platform for delivering a tool in a well with a fluid filling a substantial portion of the well, the platform comprising:

(a) a top surface for accepting the tool;

(b) a bottom surface; and (c) means for metering the flow of fluid across the platform.

2. The platform of claim 1 wherein the means for metering comprises at least one internal flow passage.

3. The platform of claim 1 wherein the means for metering comprises at least one flow passage on an outer surface of the platform.

4. The platform of claim 1 wherein the bottom surface of the platform biases the platform to a particular direction.

5. The platform of claim 1 wherein the top surface comprises a coupler for attaching the tool.

6. The platform of claim 5 wherein the coupler comprises sheer pins.

7. The platform of claim 1 wherein the tool is a perforation gun.

8. The platform of claim 1 wherein the tool is a plug.

9. The platform of claim 1 wherein the tool is a packer.

10. The platform of claim 1 further comprises at least one fin to control the descent of the platform into the fluid.

11. The platform of claim 1 wherein the platform is comprised of a drillable material.

12. The platform of claim 1 wherein the platform is comprised of aluminum.

13. The platform of claim 1 wherein the platform is comprised of a composite.

14. The platform of claim 2 wherein the at least one internal flow passages further comprise caps for sealing the passage.

15. The platform of claim 2 wherein the at least one internal flow passage is axial.

16. The platform of claim 2 wherein the at least one internal flow passage is angled.

17. The platform of claim 2 wherein the at least one internal flow passage is spiraled.

18. A platform for delivering a tool into a well that is substantially filled with a fluid, the platform comprising:

(a) a top surface for accepting a tool;

(b) a bottom surface (c) at least one flow passage on an outer surface of the platform; and (d) at least one fin for controlling the descent of the platform;

wherein the bottom surface of the platform biases the platform to a particular direction.

19. The platform of claim 18 wherein the top surface comprises a coupler for attaching the tool.

20. The platform of claim 19 wherein the coupler comprises sheer pins.

21. The platform of claim 18 wherein the means for metering comprises at least one flow passage on an outer surface of the platform.

22. A method of delivering a tool to a location in a well that is substantially filled with a fluid, the method comprising the steps of:

(a) placing the tool on a top surface of a delivery platform;

(b) positioning the platform over the well;

(c) releasing the platform into the well;

wherein no cable or tubing is connected to the platform during its descent after the releasing at step (c).

23. The method of claim 22 wherein the platform descends through the fluid in the well until stopping against a travel limit pre-placed in the well.

* * * * *